United States Patent [19]

Green

[11] Patent Number: 4,548,590

[45] Date of Patent: Oct. 22, 1985

[54] CONSTRUCTION ELEMENT

[76] Inventor: Anthony W. Green, 10 Cornwall Close, Warwick CV34 5HX, England

[21] Appl. No.: 610,810

[22] Filed: May 16, 1984

[30] Foreign Application Priority Data

May 17, 1983 [GB] United Kingdom ..... 8313507

[51] Int. Cl.[4] ..... A63H 33/06; A63H 33/08

[52] U.S. Cl. ..... 446/120; 446/125; 446/116; 403/354; 403/364

[58] Field of Search ..... 446/101, 104, 120, 121, 446/124, 125, 126, 390, 114, 116; 403/345, 354, 403/364

[56] References Cited

U.S. PATENT DOCUMENTS

| | | | |
|---|---|---|---|
| 1,095,858 | 5/1914 | Harrison | 446/102 |
| 2,022,261 | 11/1935 | Wade | 446/124 X |
| 2,554,876 | 5/1951 | Olson | 403/345 X |
| 2,583,474 | 1/1952 | Cozzone | 446/124 X |
| 2,683,329 | 7/1954 | Kobler | 446/126 X |
| 2,709,318 | 5/1955 | Benjamin | 446/126 X |
| 2,885,822 | 5/1959 | Onanian | 446/121 |
| 3,392,480 | 7/1968 | Stubbmann | 446/101 X |
| 3,469,339 | 9/1969 | Thomas | 446/126 X |
| 3,477,167 | 11/1969 | Ach | 446/120 X |
| 3,698,123 | 10/1972 | Heldt | 446/120 |
| 4,103,451 | 8/1978 | Kawada et al. | 446/121 X |

FOREIGN PATENT DOCUMENTS

| | | | |
|---|---|---|---|
| 2720641 | 11/1977 | Fed. Rep. of Germany | 446/104 |

*Primary Examiner*—Robert A. Hafer
*Assistant Examiner*—D. Neal Muir
*Attorney, Agent, or Firm*—Cushman, Darby & Cushman

[57] ABSTRACT

The construction element comprises a body which has resiliently openable jaws at least at one end thereof which are locatable between similar jaws of a further construction element with the jaws of the respective elements in mutually transverse planes. The jaws have an open front defined between free ends thereof whereby said jaws locate each other with the free ends of the jaws of each element resiliently engaging retention means on the other element.

13 Claims, 11 Drawing Figures

Figure 7:
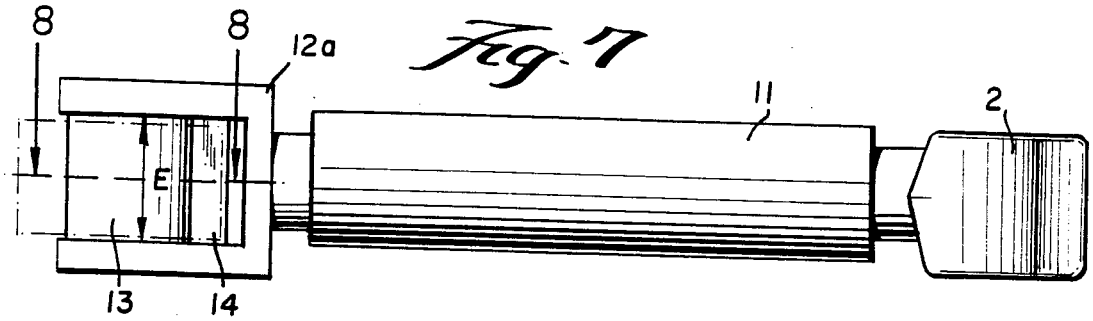

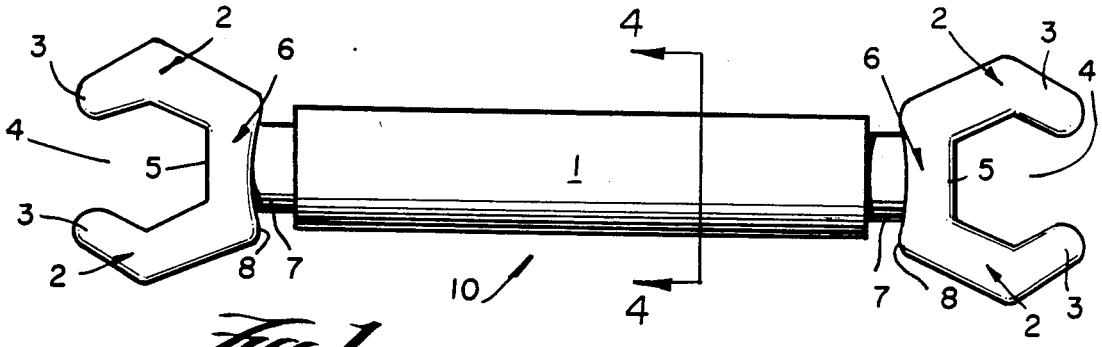
Fig. 1
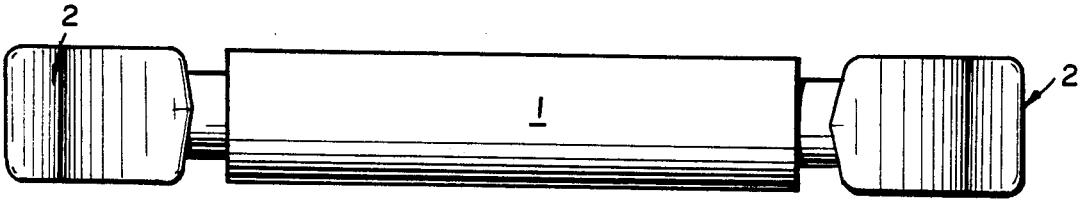
Fig. 2
Fig. 3
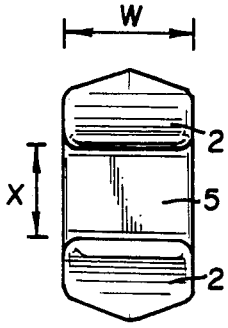
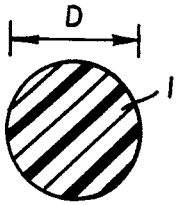
Fig. 4
Fig. 5
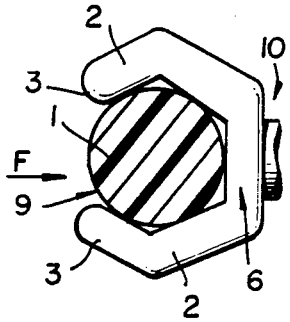
Fig. 6
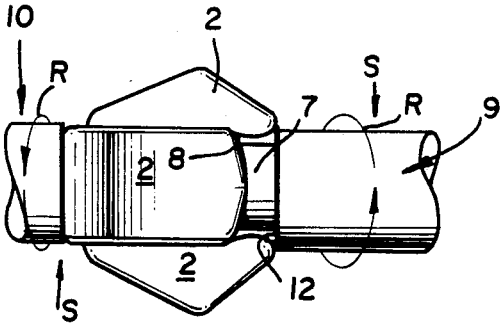
Fig. 8
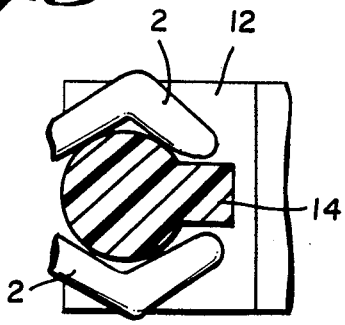

8
8
12a
11
2
E
13
14

2
12a
11
2
W
2'
14'
2 a
2
11
7
2
b
7
c
20
2

2
11
2
7
7
20
2

CONSTRUCTION ELEMENT

The invention relates to a construction element of the type which can be used, for example, with further construction elements to build models, shapes or patterns.

Many types of constructional elements have been proposed over the years. For example U.S. Pat. No. 3,550,311 describes elongate construction elements having interengageable jaws, which enable the elements to be joined end to end coaxially. However the jaws lie in the same plane when joined together and rely solely on friction to prevent the jaws sliding sideways relative to each other and becoming detected. Moreover the jaws are of complex form and tend to project considerably beyond the cylindrical surface of a rod on which they are snap fitted. U.S. Pat. No. 2,959,888 describes interlockable toy elements which also have jaws which snap together. The jaws of the elements in this case lie in mutually transverse planes and, therefore, are mechanically resistant to separation by relative sideways movement. However the frictional fit of the jaws will permit relative pivoting of the elements in the transverse planes. This can be a disadvantage when making, say, supporting legs of a model where a considerable amount of rigidity is required.

An object of the present invention is to provide a construction element having a jaw which can be located in a similar jaw of a further construction element in a manner which will provide a substantially rigid interconnection mechanically resistant to separation by sideways applied forces.

According to the invention there is provided a construction element comprising a body having resiliently openable jaws thereon locatable between similar jaws of a further construction element with the jaws of the respective elements arranged in mutually transverse planes, and a jaw retention surface on the body, said jaws defining an open front end between free ends thereof whereby said jaws locate each other with the free ends of the jaws of each element cooperating with said retention surface on the other element to inhibit relative movement between the elements.

The arrangement of the located jaws in mutually transverse planes provides the required mechanical resistance to sideways applied separation forces and the jaw retention means on the body provides the desired rigid interconnection of the two elements which gives, e.g. useful resistance to relative angular deflection of interconnected elements.

Preferably the jaws have a closed rear end so that when the jaws are located in the similar jaws the free ends of the jaws of each element are positioned behind the closed rear end of the other jaws for engagement with the retention surface. This arrangement results in a particularly rigid joint between elements. In such a case the retention surface may be defined by a rear surface of means defining the said closed rear end of the jaws.

The retention surface may comprise a groove in the body behind a closed rear end of the jaws so that when the jaws are located between the similar jaws the free ends of the jaws of each element locate in the groove behind the closed rear end of the other jaws. The aforesaid rear surface of the means defining the closed rear end of the jaws may form a wall of said groove. The use of the groove provides a very positive location for the free ends of the jaws when the two sets of jaws are brought together.

Preferably the free ends of the jaws of each element engage the retention surface of the other element in a snap-fit manner. The snap-fit provides optimum resistance to direct separation of the sets of jaws as well as increased resistance to separation by relative angular movement of the interconnected elements.

The body is preferably elongated and may have the jaws at an end thereof. The jaws are preferably dimensioned so as to snap-fit on to the body of a similar construction element. The elongate body could, of course, have jaws at each end which would preferably lie in a common plane.

The elongate body may have jaws at one end and a jaw locating member at its other end extending transversely of the body. Preferably the jaw locating member is arranged so that when the jaws of said similar construction element are located on the member they lie in a plane transverse to the plane containing the jaws at said one end of the body. The jaw locating member may comprise a transverse bar mounted on a support such as finger means on the body. The finger means may comprise two spaced fingers on the body interconnected at or adjacent free ends by the bar. Means may be provided for inhibiting rotational movement of jaws located on the jaw locating member. Such means may comprise a projection, e.g. a rib or flange, on said member which lies between said free ends of the jaws when the jaws are located on the member.

Figure 9:
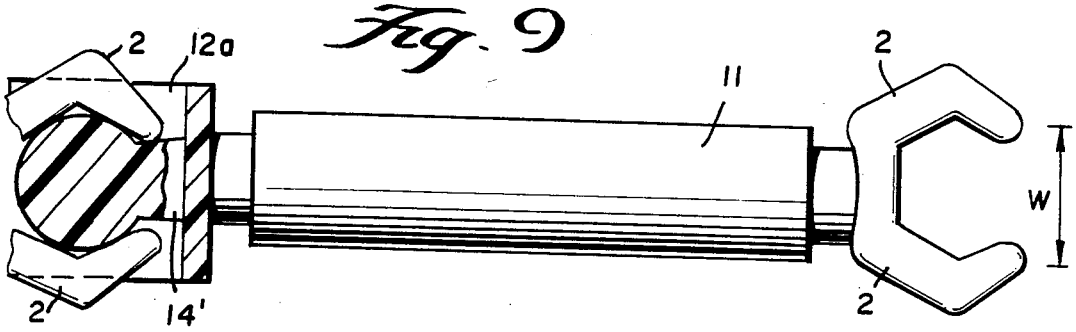
Figure 10:
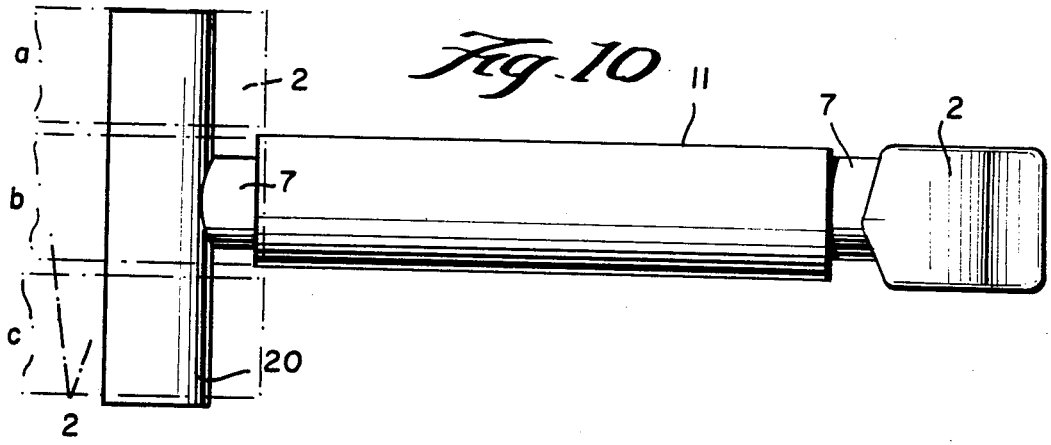
Figure 11:
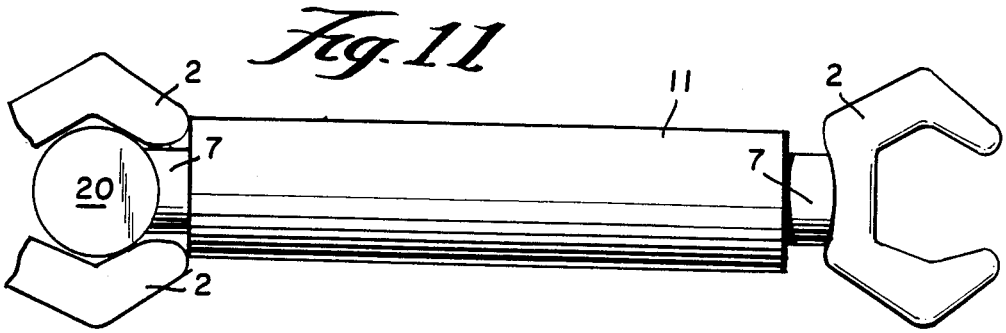

A construction element in accordance with the invention will now be described by way of example with reference to the accompanying drawings in which:

FIG. 1 is an elevation of one form of construction element in accordance with the invention having jaws at each end, FIG. 2 is a plan view of the element shown in FIG. 1, FIG. 3 is an end view of the element of FIG. 1, FIG. 4 is a cross-section of the element of FIG. 1 on the line IV—IV in FIG. 1, FIG. 5 shows the way in which jaws of the element grip the body of another element, FIG. 6 shows the way in which two sets of jaws are located one within the other, FIG. 7 shows an alternative form of element having a jaw locating member at one end and jaws at the other end, FIG. 8 is a cross section through the jaw locating member in FIG. 7 on the line VIII—VIII in FIG. 7, FIG. 9 is a cross section through an alternative form of jaw locating member, and FIGS. 10 and 11 are elevation and plan views respectively of an element having another form of jaw locating member.

Referring to FIGS. 1 to 4 a construction element 10 is moulded from resilient plastics and comprises an elongate body 1 of circular cross section. Two jaws 2 are formed at each end of the body and have free ends 3. Each pair of jaws 2 has an open front end 4 defined between the free ends 3 and a closed rear end 5 defined by an end section 6. Circumferential grooves 7 are formed in the body 1 immediately behind the end sections 6, a wall of each groove forming a rear surface 8 of the adjacent end section.

As shown in FIG. 5, the jaws 2 can be located on the body 1 of another element 9, the distance X (FIG. 3) between the free ends 3 being less than the diameter D (FIG. 4) of the body. Such location is effected by first placing the body 1 of the other element 9 against the free ends 3 of the jaws 2. A force in direction F is then applied to the element 9 thereby causing the resilient jaws to open and receive the body 1. In view of the resilient of the plastics material, the jaws 2 snap-fit on to the body 1 whereby the flat internal surfaces of the jaws 2 and end section 6 grip the body 1 at points around its periphery whilst permitting relative rotation between the two elements 9, 10 about the axis of element 9.

FIG. 6 shows the way in which jaws of the construction element 9 can be located between the jaws of construction element 10. To locate the jaws, the elements are first rotated about their longitudinal axes until the jaws lie in mutually perpendicular planes. In FIG. 6, the jaws 2 of element 9 lie in a vertical plane and the jaws 2 of element 10 lie in a horizontal plane. The open ends 4 of the jaws are then moved towards each other until the free ends 3 interengage. The distance X is less than the width of the jaws and so axial loading is necessary to cause the free ends 3 to ride over each other to permit initial intercalating of the jaws. Further axial loading is then applied to cause the free ends of the jaws of each element to ride over the end section 6 associated with the jaws of the other element and to snap into the grooves 7. Each of the free ends 3 thereby resiliently engages part of the adjacent surface 8 of the relevant end section 6 and an opposite edge 12 of the relevant groove 7. As the jaws 2 of one element overlap the jaws 2 of the other element in a snap-fit manner, the joint achieved by the intercalating jaws provides high resistance to separation by sideways applied forces S in vertical, horizontal or intermediate planes. Also, the joint is capable of transmitting rotational forces R from one element to the other and is resistant to tensile separation or separation by relative angular displacement of the elements in any plane.

Where it is not essential that the jaws grip the body 1 as in FIG. 5, the body 1 may be of reduced diameter to avoid the need for a groove 7. The jaws would then be retained simply by the surfaces 8.

Where the elements are connected as shown in FIG. 6, the jaws at the opposite end of element 9 will be in a plane perpendicular to the plane containing the jaws at the opposite end of element 10. This may be inconvenient in some instances and FIG. 7 illustrates a way of overcoming that. In FIG. 7 one end of body 1 carries jaws 2 whilst the opposite end has two parallel fingers 12*a* interconnected by a cylindrical bar 13 having a diameter equal to D. Jaws of a further element can be snapped on to the bar 13. The axis of the bar 13 lies a plane perpendicular to the plane containing the jaws 2 at the other end of the element therewith. Therefore if the body 1 is used, say, in place of element 10 in FIG. 6, jaws of a further element which locate on bar 13 will lie in the same plane as the jaws of element 11. If it is desired to prevent or limit rotation of jaws around the bar 13, the bar can be formed with a rib or flange 14 as shown in FIG. 8. The flange lies between the free ends 3 of the jaws 2.

FIG. 9 shows an alternative means of preventing or limiting rotation about bar 13 by using a tapering web 14' which extends between the bar 13 and the adjacent end of the body.

In the embodiment of FIGS. 7, 8 and 9 the distance E between the fingers is slightly greater than W.

In FIGS. 10 and 11 the body 1 has its end opposite the jaws 2 formed with a transverse bar 20, a groove 7 being formed in the body adjacent the bar. Jaws 2 of a further element can be located in position a, b or c as indicated in broken lines in FIG. 10. In positions a and c the jaws 2 can rotate about the bar 20 but in position b the jaws engage the groove 7 and such rotation is therefore prevented.

A rotary interconnection between the jaws 2 and the bar 13, 20 enable a knuckle type joint to be formed between two elements. In certain cases it may be desirable to provide an element which comprises a body having jaw engaging bars such as 13, 12 at both ends.

Whilst specific reference has been made to a body which is of elongate form the body could be of a non elongate form.

Construction elements in accordance with the invention can be used to form an infinite variety of patterns, geometric designs, models etc. and may be supplied in a pack containing elements in various colours and other constructional components such as wheels or rings.

Whilst specific embodiments of the invention have been shown and described in detail it will be understood that the embodiments may be modified or varied without departing from the spirit or scope of the invention.

What I claim as my invention and desire to secure by Letters Patent in the United States is:

1. In a construction assembly, a construction element comprising:

a body member;

a coupling member of a flexible resilient shape-retaining material, the coupling member having first and second axially extending jaws, said jaws having free end portions parallel one to the other and transverse to the axis of the jaws;

an end section for the coupling member axially spaced from the free end portions and joining an end of the first jaw to an end of the second jaw, the end section having a front surface facing the free end portions and a rear surface facing away from the free end portions, said surface having spaced-apart side walls parallel one to the other and transverse to said axis and to said free end portions;

an intermediate member axially aligned with and joining said body and coupling members and including a portion recessed relative to said body and coupling members, said recessed portion having a lesser cross-sectional dimension than the distance between the side walls, the lesser cross-sectional dimension of said recessed portion being no greater than the dimension between said free end portions of the jaws, the intermediate member having an axial length at least equal to the axial thickness of a free end portion, whereby the free end portions of the jaws of the element can flex resiliently over the side walls of another element to locate behind the rear surface of the other element to hold the elements against relative rotation about the element axis and relative movement along the element axis, the element being separable from said other element by pivoting of the element about one of its free end portions in a plane parallel to a plane including one free end portion of the other element so as to cause the other of its free end portions to flex resiliently over an associated side wall.

2. In a construction assembly, a construction element comprising;

a body member;

a coupling member of a flexible resilient shape-retaining material, the coupling member having first and second axially extending jaws, said jaws having free end portions parallel one to the other and transverse to the axis of the jaws;

an end section for the coupling member axially spaced from the free end portions and joining an end of the first jaw to an end of the second jaw, the end section having a front surface facing the free end portions and a rear surface facing away from the free end portions, said surfaces having spaced-apart side walls parallel one to the other and transverse to said axis and to said free end portions;

an intermediate member axially aligned with and joining said body and coupling members and including a portion recessed relative to said body and coupling members, said recessed portion having a lesser cross-sectional dimension than the distance between the side walls, the lesser cross-sectional dimension of said recessed portion being no greater than the dimension between said free end portions of the jaws, the intermediate member having an axial length at least equal to the axial thickness of a free end portion, whereby the free end portions of the jaws of the element can flex resiliently over the side walls of another element to locate behind the rear surface of the other element to hold the elements against relative rotation about the element axis and relative movement along the element axis, the element being separable from the other element by pivoting of the element about a free end portion of a jaw of the other element to cause the free end portion of the jaws of the element to slide along the rear surface of the other element.

3. In a construction assembly, a construction element comprising:

a body member;

a coupling member of a flexible resilient shape-retaining material, the coupling member having first and second axially extending jaws, said jaws having free end portions parallel one to the other and transverse to the axis of the jaws;

an end section for the coupling member axially spaced from the free end portions and joining an end of the first jaw to an end of the second jaw, the end section having a front surface facing the free end portions and a rear surface facing away from the free end portions, said surfaces having spaced-apart side walls parallel one to the other and transverse to said axis and to said free end portions;

an intermediate member axially aligned with and joining said body and coupling members and including a portion recessed relative to said body and coupling members, said recessed portion having a lesser cross-sectional dimension than the distance between the side walls, the lesser cross-sectional dimension of said recessed portion being no greater than the dimension between said free end portions of the jaws, the intermediate member having an axial length at least equal to the axial thickness of a free end portion, whereby the free end portions of the jaws of the element can flex resiliently over the side walls of another element to locate behind the rear surface of the other element to hold the elements against relative rotation about the element axis and relative movement along the element axis, the element being separable from the other element by pivoting of the element about a free end portion of a jaw of the other element to cause the jaws of the other element to slide along the side walls of the end section.

4. A construction element as claimed in claim 3 in which the recessed portion forms a circumferentially-extending groove.

5. A construction element as claimed in claim 3 in which the free end portion has an axial thickness equal to the axial length of the intermediate member, one face of the member being a section of the rear surface and an opposed face being parallel thereto and joined to the body member by a shoulder, the said pivoting of the element causing the said free end portions of the jaws of the element to separate and disengage from said intermediate member.

6. A construction element as claimed in claim 3, wherein each jaw comprises two planar parts, the parts being angled to the axis, the joint between the parts of associated jaws being spaced apart the same distance as the side walls forming each said pair.

7. A construction element as claimed in claim 3, wherein the axial section is a circumferential groove in the body member, the free end portions of a complementary coupling member being engageable in said groove, the groove having parallel forward and rearward surfaces engageable by said free end portions.

8. A construction element as claimed in claim 3, wherein the separation between the free end portions of the first and second jaws is less than the transverse width of the free end portions.

9. In a construction assembly;

a body member;

a coupling member of a flexible resilient shape-retaining material, the coupling member having first and second axially-extending jaws, each of said jaws having a free end portion which is parallel to the free end portion on the other of said jaws and transverse to the axis of the jaws;

an end section joining one end of the first jaw to the corresponding end of the second jaw, the end section having a front surface said jaws and a rear surface facing away from said jaws, said surfaces each having a pair of spaced-apart side walls, the side walls being parallel one to the another and transverse to said axis and transverse to said free end portions;

an axial section axially aligned with and joining the body and coupling members and including a portion recessed relative to said body and coupling members, said recessed portion having a lesser cross-sectional dimension than the distance between the side walls, the distance between the side walls forming each pair also being greater than the dimension between the free end portions of the jaws; whereby the free end portions of one coupling member can snap fit behind the side walls of the rear surface of a complementary coupling member to help hold the coupling members rigidly against relative movement along or around the axis.

10. In a construction assembly, a construction element comprising:

a body member;

a coupling member of a flexible resilient shape-retaining material, the coupling member having first and second axially extending jaws, and an end section for the coupling member axially spaced from the free end portions and joining an end of the first jaw to an end of the second jaw, the jaws having free end portions parallel one to the other and transverse to the axis of the jaws, the end section having a front surface facing the free end portions and a rear surface facing away from the free end portions, said surfaces having side walls parallel one to the other and transverse to said axis and to said free end portions, the side walls being spaced-apart a distance equal to the length of the free end portions;

an intermediate member axially aligned with and joining said body member and coupling member and including a portion recessed relative to said body and coupling members, said recessed portion having a lesser cross-sectional dimension than the distance between the side walls, the distance between the side walls also being greater than the distance between said free end portions of the jaws, the intermediate member having an axial length at least equal to the axial thickness of a free end portion, and whereby the free end portions of the jaws of the element can flex resiliently over the side walls of another element to locate behind the rear surface of the other element to hold the elements against relative rotation about the element axis and relative movement along the element axis, the element being separable from said other element by pivoting of the element about one of its free end portions in a plane parallel to one including a free end portion of the other element to cause the other of its free end portions to flex resiliently over an associated side wall.

11. In a construction assembly, a construction element comprising:

a body member;

a coupling member of a flexible resilient shape-retaining material, the coupling member being generally U-shaped having first and second axially extending jaws, and an end section for the coupling member axially spaced from the free end portions and joining an end of the first jaw to an end of the second jaw, the jaws having free end portions parallel one to the other and transverse to the axis of the jaws and of a length equal to the end section parallel thereto, the end section having a front section parallel thereto, the end section having a front surface facing the free end portions and a rear surface facing away from the free end portions, said surfaces having spaced-apart side walls parallel one to the other and transverse to said axis and to said free end portions;

an intermediate member axially aligned with and joining said body member and coupling member and including a portion recessed relative to said body and coupling members, said recessed portion having a lesser cross-sectional dimension than the distance between the side walls, the lesser cross-sectional dimension of said recessed portion being no greater than the dimension between said free end portions of the jaw, the intermediate member having an axial length at least equal to the axial thickness of a free end portion; and whereby the free end portion of the jaws of the element can flex resiliently over the side walls of another element to locate behind the rear surface of the other element to hold the elements against relative rotation about the element axis and relative movement along the element axis, the element being separable from said other element by pivoting of the element about one of its free end portions in a plane parallel to one including a free end portion of the other element to cause the other of its free end portions to flex resiliently over an associated side wall.

12. In a construction assembly, a construction element comprising:

a body member;

a coupling member of a flexible resilient shape-retaining material, the coupling member being generally U-shaped and having first and second axially extending jaws, and an end section for the coupling member axially spaced from the free end portions and joining the ends of the jaws and of the same width as the jaws, the jaws having free end portions parallel one to the other and transverse to the axis of the jaws and the end section and transverse to the axis of the jaws and the end section having a front surface facing the free end portions and a rear surface facing the free end portions and a rear surface facing away from the free end portions, said surfaces having spaced-apart side walls parallel one to the other and transverse to said axis and to said free end portions;

an intermediate member axially aligned with and joining said body member and coupling member and including a portion recessed relative to said body and coupling members, said recessed portion having a lesser cross-sectional dimension than the distance between the side walls, the lesser cross-sectional dimension of said recessed portion being no greater than the dimension between said free end portions of the jaw, the intermediate member having an axial length at least equal to the axial thickness of a free end portion; and whereby the free end portions of the jaws of the element can flex resiliently over the side walls of another element to locate behind the rear surface of the other element to hold the elements against relative rotation about the element axis and relative movement along the element axis, the element being separable from said other element by pivoting of the element about one of its free end portions in a plane parallel to one including a free end portion of the other element to cause the other of its free end portions to flex resiliently over an associated side wall.

13. In a construction assembly, a construction element comprising a body member;

a coupling member;

the body member and the coupling member being integrally moulded in a plastics material;

a groove defined in the body member adjacent the coupling member, said groove establishing an inner cylindrical surface;

the coupling connector having a pair of openable jaws, the jaws being sized and shaped to be in interference fit with the defined groove of a similar element upon axial presentation of the jaws of the element with its jaws at 90° to the jaws of the similar element, with respective jaws being mutually urged apart over the coupling connector and into the said interference fit upon continued axial pressure, whereby to achieve a non-rotatable relative engagement between the elements about an axis of an element.

* * * * *